United States Patent [19]

Buban et al.

[11] Patent Number: 4,465,208

[45] Date of Patent: Aug. 14, 1984

[54] CHEWING GUM DISPENSER

[76] Inventors: Ray M. Buban; Deborah L. Buban, both of 1159 13th St., Los Osos, Calif. 93402

[21] Appl. No.: 445,361

[22] Filed: Nov. 29, 1982

Related U.S. Application Data

[63] Continuation of Ser. No. 153,167, May 27, 1980, abandoned.

[51] Int. Cl.[3] ..... B65D 83/08

[52] U.S. Cl. ..... 221/279; 206/800; 221/281

[58] Field of Search ..... 221/232, 279, 280, 281, 221/198, 56-60; 206/39.5, 556, 800; 312/61, 71; 271/160, 169, 170

[56] References Cited

U.S. PATENT DOCUMENTS

| | | | |
|---|---|---|---|
| 355,207 | 12/1886 | Reinfeld | 206/39.5 |
| 748,272 | 12/1903 | Flora | 221/232 X |
| 806,985 | 12/1905 | Mallory | 206/39.5 |
| 1,131,112 | 3/1915 | Brown | 221/231 |
| 1,155,791 | 10/1915 | Cabell | 206/800 |
| 1,244,338 | 10/1917 | Johnson | 221/232 |
| 2,216,476 | 10/1940 | Mutz | 221/198 |
| 3,397,818 | 8/1968 | Rey | 221/232 |
| 3,635,468 | 1/1972 | Suzuki | 221/198 X |
| 3,919,972 | 11/1975 | Komori et al. | 271/169 X |
| 4,170,914 | 10/1979 | Carrier | 206/800 X |
| 4,171,753 | 10/1979 | Vreede | 221/198 X |
| 4,301,917 | 11/1981 | Ancell | 206/39.5 |

*Primary Examiner*—F. J. Bartuska

*Attorney, Agent, or Firm*—Grover A. Frater

[57] ABSTRACT

A dispenser of chewing gum and other stick-shaped products includes a rectangular container having an upper cover whose central region is cut away to afford access to the stick product which rests atop a false bottom. The latter is urged upward by bias springs so that the sticks may be dispensed by engaging the upper surface of the top stick through the opening with the user's thumb and pushing it through a dispensing opening with a rubbing motion of the thumb. The cover is retractable to permit reloading of the dispensing.

1 Claim, 10 Drawing Figures

CHEWING GUM DISPENSER

This is a continuation of application Ser. No. 153,167, filed May 27, 1980 now abandoned

TECHNICAL FIELD

This invention relates to improvements in apparatus for dispensing material, such as chewing gum, which is produced and stored in the form of sticks of uniform size.

BACKGROUND OF THE INVENTION

There are a substantial number of products which are, or advantageously could be, produced in stick form. Cosmetic items, preformed bandages, etc. are examples. Chewing gum is another example of a stick product with which the invention is particularly useful, and it is this application for the invention which has been selected for detailed description herein.

Chewing gum is most commonly produced in the form of flat, rectangular sticks which are individually wrapped, bound in an encompassing paper outer wrapper, and arranged flat side against flat side in packs of five or more sticks. The pack is wrapped in a separate wrapper which is sealed to prevent evaporation of moisture and a "drying out" of the product. Removing the wrapping from individual sticks is not particularly difficult. It is, in fact, relatively easy to remove that wrapper with one hand, and the habitual gum chewer usually developes that ability quickly and easily.

Removal of the outer wrapper is not so easy. Ordinarily, that task requires two hands. It is common practice to arrange the outer wrapper so that one end section can be removed and thrown away. Most of the original outer package serves as a sheath in which the five sticks may be stored. That original outer wrapper is not a very desirable storage device. The first two of the five sticks are ordinarily sufficiently difficult to remove from the sheath so that two hands are required. Two sticks having been removed, the remaining three fit so losely within the sheath that they are likely to become separated from it.

While difficulty in removing the gum from the sheath occurs initially, and while subsequentially having to deal with loosened sticks of gum may not be a pressing problem, it can, however, ba a nuisance, and even dangerous. It can be dangerous, for example, if the habitual gum chewer attempts to provide himself with a stick of gum while driving an automobile. The need to use two hands to remove the initial sticks of gum from the sheath, or the need to look away from the road in an effort to locate a loosed stick, can have serious consequences.

SUMMARY OF THE INVENTION

It is an object of this invention to provide an improved dispenser for articles that are stored and dispensed in stick form. It is a particular object of the invention to provide an improved dispenser for sticks of chewing gum.

The invention provides a dispensing unit that can hold five individually wrapped sticks of chewing gum, the number that are ordinarily packaged together in a single outer wrapper. The dispenser is arranged so that the individual sticks can be stored without moving their separate wrappers. The object is to provide a dispensing device that can be operated with one hand. Since it is removal of the sticks from the outer wrapper, rather than the removal from the individual wrappers, that presents the problem, the preferred form of the invention is arranged so that the chewing gum sticks can be stored several at a time in their original individual wrappers. Nonetheless, the dispenser of the invention can be used to store gum sticks whose individual encompassing paper bands are removed prior to storage in the dispensing device. That feature makes it possible for one who has difficulty in removing the individual package with one hand to solve that problem by storing the chewing gum sticks with the individual wrappers partially removed.

To provide those several advantages is also an object of the invention, and a further object is to provide a dispenser which not only can be operated with one hand but can be properly oriented and operated without a need to look at the dispenser. Utility is increased if storing the gum in the dispenser is readily accomplished, and if the structural arrangement is such that slight variations in the dimensions of the gum sticks have no adverse effect on the ease and the reliability with which dispensing can be accomplished.

These several objects of the invention, and other objects and advantages, which will become apparent from a reading of the specification that follows are realized in the invention by the provision of a container which has a false bottom resiliently biased toward the upper wall of the container such that sticks of material within the container are urged toward the cover. In the preferred form, the cover is provided with an opening at which the surface of the stored element is exposed and where the user's thumb can be made to force an element through an end opening in the container with a rubbing motion of the thumb.

THE DRAWINGS

DESCRIPTION OF THE PREFERRED EMBODIMENT

Figure 1:
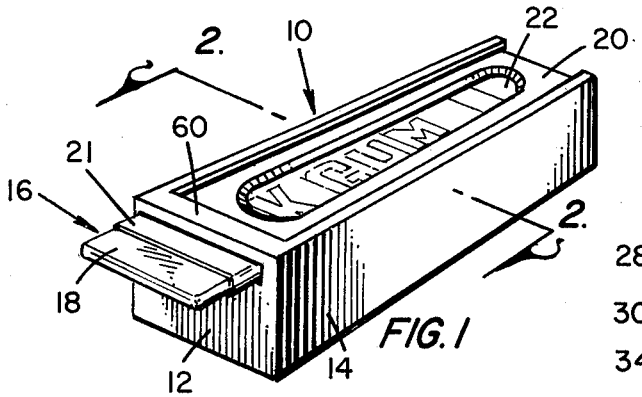
FIG. 1 is an isometric view of a preferred form of dispenser according to the invention from which one end of a stick of chewing gum is shown to project; (The chewing gum has been omitted from the remainder of the views.)

The dispenser is shown in an isometric view in FIG. 1 where it is generally designated 10. The front wall 12 of the body 14 is formed with a dispensing opening. A stick of chewing gum 16 extends partially through that opening. The gum stick is individually wrapped in conventional form. It is wrapped first in a waxed and silvered paper 18, and the central region of the stick is encompassed by a paper band 20.

The cover 20 of the dispenser is formed with an elongated, oval-shaped, through opening through which part of the gum stick 16 is visible. At the rearward end of the dispenser a small portion of a second stick 22 of chewing gum is visible. It is the gum stick just below the stick 16 in the container.

The dispenser is operated by placing it in the palm of the user's hand, either the right hand or the left hand, such that the forward wall 12 of the dispenser extends from the hand in the direction of the forefinger and thumb. The thumb is placed atop the cover. The oval opening is sufficiently large, and the cover sufficiently thin, so that the thumb will engage the encompassing paper wrapper 20 of the gum stick. Forward motion of the thumb relative to the palm and forefinger results in pushing the gum stick so that its forward end emerges from the dispensing opening to the position shown in FIG. 1. After two or three such rubbing actions, the gum stick will have been dispensed sufficiently so that it is easily removed from the dispenser.

Figure 2:
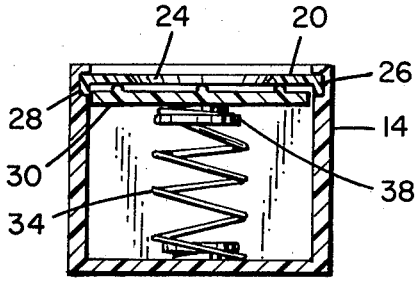
FIG. 2 is a cross-sectional view of the dispenser taken on line 2—2 of FIG. 1.

The interior of the dispenser is shown in FIG. 2 where the opening in the cover member 20 is designated by the numeral 24. The cover may be removed. Its sides 26 and 28 are slidably disposed in grooves formed on the inner wall of the body 14. The forward edge of the cover 20 abuts the rear side of the forward wall 12 when the cover is fully assembled on the body. It can be retracted, which will be more fully explained below, so that the body can be loaded with fresh sticks of gum.

The dispenser is provided with a false bottom 30 which is almost as long and almost as wide as the inner length and inner width of the body. A means is provided for urging the false bottom upwardly toward the open upper side of the body or, when the cover 20 is in place, against the lower surface of the cover.

Figure 10:
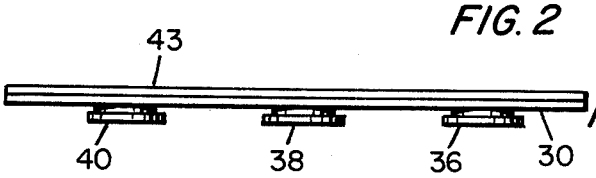
FIG. 10 is a view in side elevation of the false bottom.

In the preferred form of the invention, a resilient biasing means is employed to urge the false bottom upwardly. In this preferred embodiment, that means is formed by three coiled springs. Each of the other two is just like the spring 34 that is visible in FIG. 2. The lower end of the spring is engaged on a button formed integrally with the inner bottom wall of the housing 14. At its upper end, each spring is mounted upon a respectively associated button that is formed integrally and extends downwardly from the lower face of the false bottom 30. There are three such buttons on the lower face of the false bottom as best shown in FIG. 10 where they are designated 36, 38 and 40, respectively. The buttons are formed as discs that are disposed atop a short cylindrical stem. The last coil at each end of each spring has slightly smaller diameter than do the remaining coils. That diameter is less than the diameter of the disc of each button. The spring is assembled on the button by having its end coil spread open while that coil is placed behind the disc. When allowed to relax, the end coil is trapped behind the disc.

It is possible to use other numbers and other forms of springs, but three springs spaced apart lengthwise and disposed along the longitudinal midline of the unit have exhibited best performance. The three springs serve to force the chewing gum sticks upwardly so that the uppermost is held parallel with the lower face of the cover member on the same plane that contains the dispensing opening in end 12. The upward force of the spring is sufficiently uniform so that the uppermost gum stick is easily dispensed whether the thumb rubbing action that accomplishes dispensing is applied at the forward or the center or the rearward end of the oval cover opening.

Figure 9:
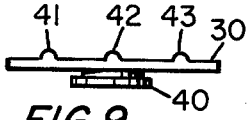
FIG. 9 is an end view of the false bottom.

The false bottom exerts a significant amount of force, but the individual gum stick wrapping presents little friction to sliding motion of one stick against the other so that dispensing is easily accomplished. In the preferred form, the upper surface of the false bottom is provided with three spaced longitudinal ribs on its upper surface. These ribs, which are identified by the reference numerals 41, 42 and 43 in FIG. 9 serve to reduce the area of contact between the upper surface of the false bottom and the lower surface of the last gum stick to be dispensed.

Figure 7:
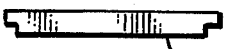
FIG. 7 is an end view of the cover member.
Figure 8:
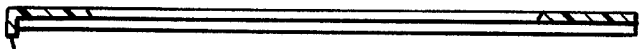
FIG. 8 is a cross-sectional view of the cover member taken on line 8—8 of FIG. 6.
Figure 6:
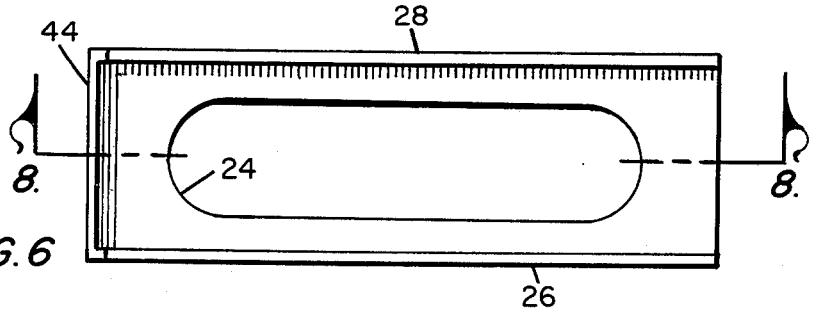
FIG. 6 is a bottom plan view of the cover member of the unit of FIG. 1.
Figure 4:
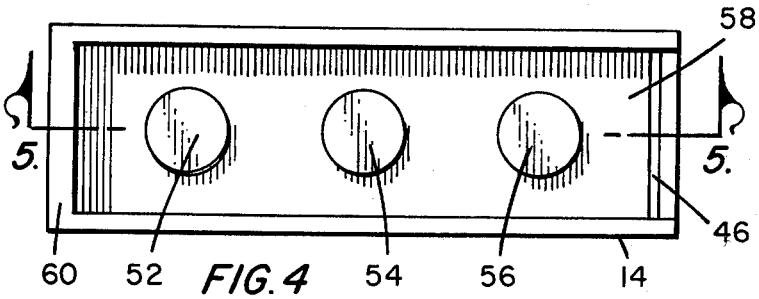
FIG. 4 is top view of the body of the dispenser, all of the other parts having been removed.

The cover member is shown in FIGS. 6, 7 and 8. It has the shape of an inverted channel or an inverted "U" when assembled with the remainder of the structure, as best shown in FIG. 2. The side walls 26 and 28 of the channel are relatively short. The oval opening 24 has bevelled sides so that the opening at the upper face of the cover is somewhat larger than the opening at the lower face. At its forward edge, the cover is provided with a low transverse lip. That lip serves as a stop to limit the degree in which the cover is moved from the body when it is retracted to permit installation of more chewing gum sticks to the dispenser. The lip is identified by the reference numeral 44. That lip 44 engages the transverse notch 46 which can be seen at the upper rear of the body 14 in FIGS. 4 and 5. In the preferred form of the invention the dimensions are such that the cover can be forced into assembled position, notwithstanding the presence of the lip. Nonetheless, the lip is engaged in the notch when the cover is retracted to provide a tactile signal indicating that the cover is fully retracted and that the dispenser is in condition to be loaded with more sticks of chewing gum.

Figure 5:
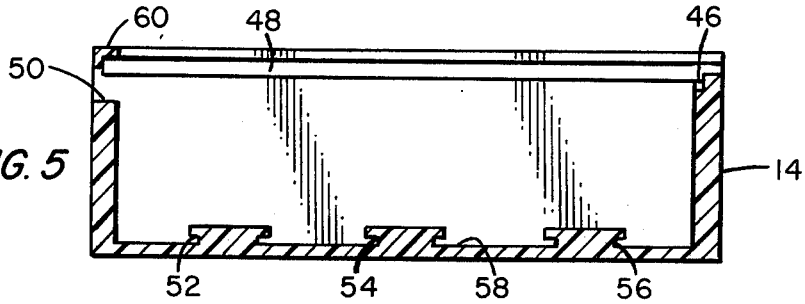
FIG. 5 is a cross-sectional view of the body of the dispenser taken on line 5—5 of FIG. 4.
Figure 3:
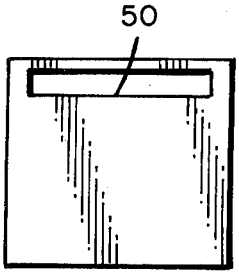
FIG. 3 is a view in front elevation of the dispenser of FIG. 1.

In FIG. 5, the numeral 48 identifies the longitudinal groove in which the side wall 26 of the cover is slidably disposed. The dispensing opening is numbered 50. It is sufficiently wide so that one stick of gum may pass easily through it, but it is sufficiently small so that two sticks cannot be accommodated at the same time. Three buttons, 52, 54 and 56, are formed at the interior of the housing 14 on the inner surface of the bottom wall 58. The three buttons are spaced apart and are arranged on the longitudinal center line of the housing. They are positioned opposite the three buttons of the false bottom when the latter is in assembled position within the body. As previously described, they serve to engage and hold the lower end of respectively associated ones of the three bias springs.

One of the features of the dispenser is the cross member 60 which extends across the upper side of the housing 14 at its forward end. That cross member is disposed entirely above the track 48 of FIG. 5 and the corresponding track, not shown, at the other side wall of the body. When a supply of gum sticks is added to the dispenser, the pack is placed atop the false bottom and is pushed downwardly. The forward edge of the upper stick is pushed under the cross member 60. That having been done, it is but a simple matter to hold the pack against the bias of the springs while moving the cover member forwardly. As the cover is moved forwardly, that top stick, and indeed the entire pack, is moved downwardly so that the top stick of gum is aligned with the dispensing opening.

When a stick of gum is to be forced from the dispenser, the user's thumb, or any other finger for that matter, is placed over the cover opening 24 so that part of the thumb extends through the opening and engages the upper surface of the upper chewing gum stick. That upper stick must be pressed down with sufficient force against the bias of the three false bottom springs so that the forward end of the stick will be lowered slightly to clear the stop 44 at the forward edge of the cover member. If the lower face of the stop is engaged by the upper face of the gum stick being dispensed during the dispensing procedure, it matters not. Only a very small degree of friction is encountered in moving past the stop. In the preferred embodiment, the dispensing opening 50 is arranged so that its upper margin lies above the level of the lower face of stop 44. Thus, the stop 44 prevents the emerging gum stick from engaging the upper side of the opening 50. Dispensing is facilitated by increasing the size of opening 50, but its height must be smaller than the height of two gum sticks to prevent the dispensing of two of them at a time. Since some users might prefer to remove the outer encompassing wrapper of the individual sticks prior to loading a pack of sticks in the dispenser, the height of the opening 60 must be less than the heights of two sticks with wrappers removed. The cover opening is made relatively long so that the brand name of the chewing gum will be visible through the cover, and so that the device is used with equal facility by persons with large hands and by persons with small hands. Because the opening is long, the dispenser must be made to work well whether the dispensing force is placed at a forward portion of that cover opening or at a rearward portion. That means that the top gum stick must remain substantially parallel to the cover, notwithstanding that it is pressed well below the level of stop 44 and notwithstanding that the force may be applied at either end or at the mid-region of the stick to be dispensed. The use of the stiff, false bottom, together with resilient elements that act over substantially the entire length of that false bottom, serves to ensure that the orientation of the stick to be dispensed remains proper over a wide range of dispensing force conditions. The fact that the gum pack is pressed upwardly against the cover helps in preserving freshness of the others of the pack notwithstanding that the upper stick is exposed to the cover opening. The design selected for illustration in the drawings, and for this description, has proven to be very effective and reliable, and is the preferred embodiment of the invention.

Although we have shown and described certain specific embodiments of our invention, we are fully aware that many modifications thereof are possible. Our invention, therefore, is not to be restricted except insofar as is necessitated by the prior art.

We claim:

1. A dispenser for dispensing sticks of chewing gum, which sticks have a given thickness, one at a time, comprising, in combination:

a container having a bottom wall, two side walls, two end walls, and a top wall, and having size to receive a plurality of sticks of chewing gum arranged contigiously in a stack such that the sticks lie substantially parallel to one another and to said top and bottom walls of said container;

a plate disposed within said container substantially parallel with said top and bottom walls;

means in the form of a resilient element for urging said plate and any stack of gum sticks disposed thereon toward the underside of said top wall;

the top wall being formed by a first portion and second portion; said second portion of said top wall being adjacent to one end wall and extending from one of said two side walls to the other; said first portion is retractable in the plane of said top wall in the direction away from said second portion;

said first portion of said top wall having an opening formed therethrough which opening is elongated along the centerline of said top wall in the direction of the ends of said containers;

said one end wall having an outlet opening formed therethrough which is rectangular in shape and extends in width from one side wall to the other side wall of said container, and extends in height from an upper edge which lies a distance less than the height of said outlet opening below the plane of the underside of said top wall to a lower edge which is greater than said thickness of a stick of chewing gum but less than twice said thickness.

* * * * *